United States Patent [19]

Jacobsen

[11] Patent Number: 4,657,085

[45] Date of Patent: Apr. 14, 1987

[54] SPRINKLER UNIT

[75] Inventor: Allan Jacobsen, Haarby, Denmark

[73] Assignee: G. W. Sprinkler A/S, Holte, Denmark

[21] Appl. No.: 873,089

[22] PCT Filed: Dec. 6, 1983

[86] PCT No.: PCT/DK83/00113

§ 371 Date: Aug. 3, 1984

§ 102(e) Date: Aug. 3, 1984

[87] PCT Pub. No.: WO84/02280

PCT Pub. Date: Jun. 21, 1984

Related U.S. Application Data

[63] Continuation of Ser. No. 638,468, Aug. 3, 1984, abandoned.

[30] Foreign Application Priority Data

Dec. 7, 1982 [DK] Denmark ..... 5413/82

[51] Int. Cl.[4] ..... A62C 37/14

[52] U.S. Cl. ..... 169/43; 169/38

[58] Field of Search ..... 169/37–43

[56] References Cited

U.S. PATENT DOCUMENTS 4,109,727 8/1978 Job ..... 169/41

FOREIGN PATENT DOCUMENTS 2019817 12/1970 Fed. Rep. of Germany .
2300434 7/1973 Fed. Rep. of Germany .
1118526 7/1968 United Kingdom .
1349935 9/1971 United Kingdom ..... 169/37
1582360 1/1981 United Kingdom .

*Primary Examiner*—Joseph F. Peters, Jr.
*Assistant Examiner*—Mary Beth O. Jones
*Attorney, Agent, or Firm*—Fleit, Jacobson, Cohn & Price

[57] ABSTRACT

The body (1) of the sprinkler unit and the valve body (2) are formed with three cooperating shoulders (14,15) in the flow passage (6,8) to accommodate a seal (3) which, in the working state, serves both as a locking ring for the valve body (2) and to partly elastically absorb changes in the length of a rupturable valve caused by variations in the ambient temperature, while an O-ring (4) between the valve body (2) and the bulb (5) absorbs the remaining tensions. A third upstream shoulder (12) formed on the valve body (2) entrains the sealing element (3) when inserting the bulb (5) and the valve body (2) through the flow passage (6, 8). The sealing elements (3) then automatically slides in an axially enlarged annular groove (7) provided in the outer surface of the valve body (2), to the downstream shoulder (14) of the groove (7) into a locking tight-fit position between the cooperating shoulders (14, 15) during the subsequent obligatory pressure test of the unit, and it is ejected automatically together with the bulb upon activation for a sprinkling operation.

2 Claims, 2 Drawing Figures

SPRINKLER UNIT

Figure 1:
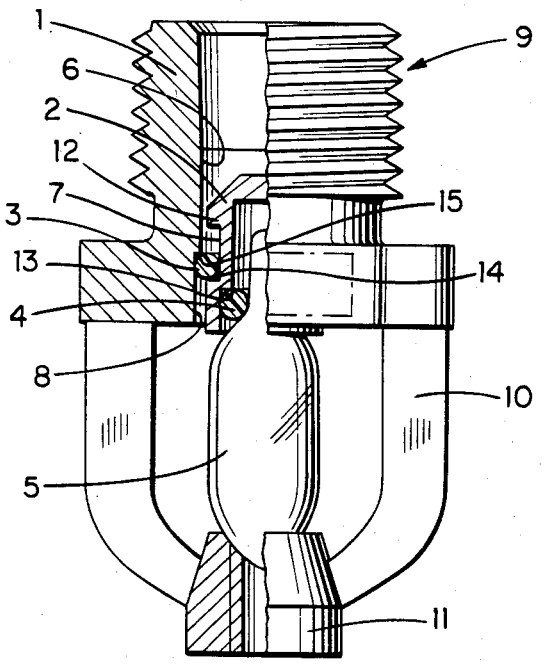

This application is a continuation of application Ser. No. 638,468, filed Aug. 3, 1984 abandoned.

The invention relates to a sprinkler unit of the type which is supplied from the factory in an assembled state, ready for mounting in situ in an existing piping for the supply of a first extiguishing fluid in buildings and the like.

Such sprinkler units are assembled at the factory by insertion of the bulb into engagement with the bushing and subsequent insertion of the seal and the valve body, and the assembled unit is then subjected to pressure tests according to current standards.

The German Offenlegungsschrift No. 2 300 434 discloses a sprinkler unit of the stated type in which a dual bulb is inserted into the valve body which is to be inserted from the outside to engage the seal, and the bulb and the valve body are then fixed against the inner end of the body by the tightening of the bushing at the outer end of the body. This insertion operation is complicated, and the seal will be under a constant pressure due to the fixed state.

The British Patent Specification No. 1 582 360 discloses a sprinkler unit of the same type in which the inner end of the bulb is journalled directly in the outer end of the valve body, and the flow passage of the fluid is substantially circular-cylindrical in shape, the surface of the bore in the body having a recess for receiving the seal. This structure requires special care in the mounting operation, and it is not certain that the valve body will not be sucked backwards and release the bulb in the event that a negative pressure is generated in the piping when the piping is drained.

The British Patent Specification No. 1 595 116 and the German Offenlegungsschrift No. 2 921 304 disclose a sprinkler unit of a similar type in which the outer end of the bulb, without any intermediate valve body, engages the body through the seal, which upon insertion is kept in place by insertion of a thin tubular bushing. The fragile end of the bulb is unprotected during the mounting operation, and in case of release the seal will hang in the body and thus impede out-flow of the fluid.

The object of the invention is to provide a sprinkler unit of the stated type without these drawbacks.

This object is achieved according to the invention with a sprinkler unit of the type stated, where a flow passage is provided with an additional shoulder formed at an end portion of a valve body facing a piping application end of a unit body, whereby said additional shoulder will engage with a sealing element and move said element along the flow passage to rest in a working position in a staggered portion of said passage upon exertion of fluid pressure on the valve body.

The invention also relates to a method of assembling such a sprinkler unit at the factory, said method comprising the steps of inserting a bulb into the piping application end of the bore in the unit body to journal one end of the bulb in a bushing, then inserting the valve body, having an O-ring inserted therein and the sealing element loosely applied on the valve body surface, through the bore into engagement with an opposite end of the bulb, and subjecting the unit thus assembled to an actual pressure test, the sealing element thereby being pressed into working position by the additional shoulder without additional manipulations.

When the sprinkler unit of the invention is assembled at the factory, the sealing elment is simply placed around the valve body and is urged down by the additional shoulder on the valve body surface when the valve body, with the O-ring inserted therein, is urged through the bore in the unit body toward the previously positioned bulb.

During the subsequent obligatory pressure test the pressure fluid then automatically presses the seal into position between the shoulders at the staggered portion of the flow passage without any additional manual operations being needed, and the sealing element will then act both as a locking ring for the valve body against possible inward movement of the valve body in case of a reduction in the pressure in the piping, and as an equalizing means for partial absorption of tensions caused by random variations in the bulb length, maintaining the sealing function. In the event of a release, the sealing element will be positively ejected so that a new bulb can be inserted unimpededly. The O-ring absorbs the rest of the length variation tensions and provides additional protection against bulb rupture during assembling.

The valve body sealing element may expediently be an O-ring of the same material as the O-ring serving to journal the bulb, preferably VITON ® which can resist temperatures up to 250° C.

Figure 2:
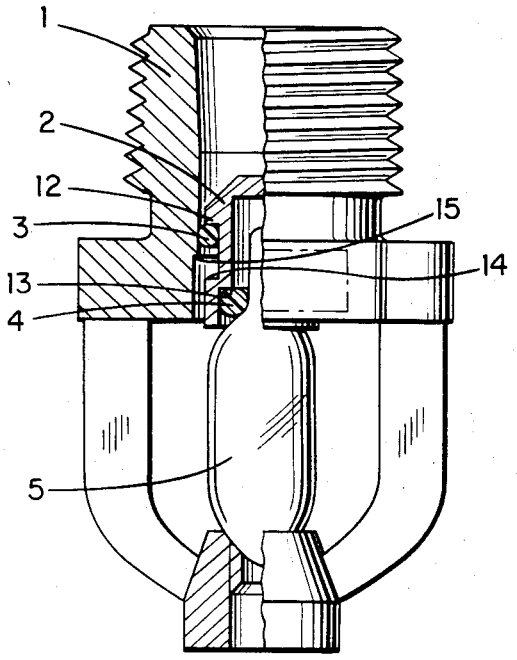

The invention will be explained more fully below with reference to the drawing, in which FIG. 1 is a longitudinal section of an embodiment the sprinkler unit of the invention, showing the sprinkler unit ready for sale, and FIG. 2 is a longitudinal section of the sprinkler unit during its assembling at the factory.

As shown in FIG. 1, the sprinkler unit of the invention comprises a unit body 1 with external threads 9 at one end for application to an existing piping in a fire extinguishing system, a bore 6 serving as a flow channel and having a sealing surface 8 which is enlarged through an internal shoulder and which may extend parallel with the longitudinal axis of the unit body or form an angle with said axis of up to 15°. The other end of the unit body 1 is moreover conventionally extended outwards with two supporting legs 10 which mount a bushing 11 intended as an outer bearing for a sprinkler bulb 5 of a conventional profile.

A valve body 2 of the sprinkler is formed as an end sleeve with a cavity to receive the inner end of the bulb 5 and with an outer surface provided with an axially enlarged annular groove 7 to receive a sealing element 3, e.g., movable from an upstream shoulder 12 (FIG. 1) of the groove 7 to a downstream shoulder 14 (FIG. 1) of the groove by the action of fluid pressure from the piping end of the unit body 1. The valve body 2 is further provided with an internal shoulder, 3 for a second O-ring 4 to provide an elastic attachment of the neck portion of the bulb 5 and to absorb, together with the seal 3, the expansions and contractions of the bulb caused by changes in the ambient temperature. Like the inner sealing surface 8 of the unit body 1, the outer sealing surface of the valve body 2 with the groove 7 may extend parallel with the longitudinal axis of the unit body or form an angle with said axis of up to 15°.

As is clearly shown in FIGS. 1 and 2, the sealing surface 8 of the unit body 1 is profiled with a staggered portion forming an introverted shoulder 15 cooperating with the downstream shoulder 14 of the groove 7 in the valve body 2 to lock the sealing element 3 in a tight-fit position after assembling.

The sprinkler unit of the invention is assembled at the factory by passing the bulb 5 through the bore 6 in the body 1 and centering it in the bushing 11. Then the valve body 2 with the seal 3 applied to it against the upstream shoulder 12 of the groove 7, is passed into the bore 6, as shown in FIG. 2. The assembling of the sprinkler unit is completed by subjecting it to a test pressure from the inlet side, and the seal 3 then automatically slides donwstream in the groove 7 into the locking position between the downstream shoulder 14 of the valve body 2 and the staggered shoulder 15 of the unit body 1, as shown in FIG. 1, ready for use.

I claim:

1. A sprinkler unit for use in systems for temperature responsive supply of a pressurized fluid through a piping to extiguish fires in buildings, comprising a unit body (1) having an axial central bore extending therethrough, a heat rupturable bulb (5), and a valve body (2) substantially axially movable with respect to the unit body in the bore of said unit body and closing the bore when in a resting position against an upstream end of the bulb via a sealing element (3), an upstream end of the unit body being adapted for stationary application to the piping and a downstream end of the unit body being provided with a bushing (11) for journalling a downstream end of the bulb, said valve body being movable through the bore of said unit body and provided in an outer surface with an axially enlarged annular groove (7) having said sealing element disposed therein adjacent an inner surface of the bore so that said sealing element is axially moveable along said groove, said groove in the inserted position of the valve body extending axially both upstream and downstream of a shoulder (15) provided in the inner surface of the bore and cooperating with a downstream shoulder (14) of the groove to retain the sealing element in a locking position constituting a tight-fit after exertion of a standard fluid test pressure on the assembled unit at a factory.

2. A method of assembling a sprinkler unit, comprising the steps of inserting a heat rupturable bulb into an end of a piping application which includes a unit body having a bore, journaling a downstream end of the bulb in a bushing located outside the downstream end of the bulb, then inserting a valve body having a sealing element loosely applied on an upstream shoulder of an axially extending annular groove in the outer surface of said valve body, partially into said bore in said unit body and into engagement with an upstream end of the bulb via an O-ring inserted on a shoulder at a downstream end of a valve body inner surface, and subjecting the unit thus assembled to a standard pressure test in a factory whereby the sealing element is moved downward in the annular groove and pressed against a downstream shoulder of the axially extending groove in the valve body, and simultaneously moved past a corresponding introverted shoulder on an inner surface of the bore in the unit body into a locking-and-sealing position in the unit body constituting a tight-fit between the last two mentioned shoulders.

* * * * *